US006685300B1

(12) United States Patent
Ishiyama et al.

(10) Patent No.: US 6,685,300 B1
(45) Date of Patent: Feb. 3, 2004

(54) DEVICE AND METHOD FOR DRIVING INK JET PRINTING HEAD CAPABLE OF ATTAINING BOTH HIGH QUALITY PRINTING AND REDUCTION OF INK CONSUMPTION

(75) Inventors: Toshinori Ishiyama, Tokyo (JP); Masakazu Okuda, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 2 days.

(21) Appl. No.: 09/613,808

(22) Filed: Jul. 11, 2000

(30) Foreign Application Priority Data

Jul. 14, 1999 (JP) ..... 11-200938

(51) Int. Cl.[7] ..... B41J 2/165
(52) U.S. Cl. ..... 347/23; 347/35
(58) Field of Search ..... 347/7, 10, 14, 347/23, 27, 30, 35, 70, 17, 11, 60

(56) References Cited

U.S. PATENT DOCUMENTS

| | | | | | |
|---|---|---|---|---|---|
| 4,245,224 | A | * | 1/1981 | Isayama et al. | 347/35 |
| 4,567,494 | A | * | 1/1986 | Taylor | 347/30 |
| 4,926,196 | A | * | 5/1990 | Mizoguchi et al. | 347/23 |
| 5,264,865 | A | * | 11/1993 | Shimoda et al. | 347/11 |
| 5,541,628 | A | * | 7/1996 | Chang et al. | 347/10 |
| 5,565,898 | A | * | 10/1996 | Sakuma | 347/23 |
| 5,659,342 | A | * | 8/1997 | Lund et al. | 347/35 |
| 6,033,050 | A | * | 3/2000 | Morita et al. | 347/23 |
| 6,286,928 | B1 | * | 9/2001 | Kasamatsu | 347/23 |

FOREIGN PATENT DOCUMENTS

| | | |
|---|---|---|
| JP | 53-12138 | 4/1978 |
| JP | 57-61576 | 4/1982 |
| JP | 63-260450 | 10/1988 |
| JP | 4-97853 | 3/1992 |
| JP | 9-29996 | 2/1997 |
| JP | 10-193587 | 7/1998 |
| JP | 11-20197 | 1/1999 |

* cited by examiner

*Primary Examiner*—Stephen D. Meier
*Assistant Examiner*—Blaine Mouttet
(74) *Attorney, Agent, or Firm*—Sughrue Mion, PLLC

(57) ABSTRACT

A driving method for an ink jet printing head includes a vibration application step and an ink refresh operation step. In the vibration application step, small vibrations, which do not cause ink drop discharge from nozzles of the ink jet printing head, are applied to pressure-generation chambers of the ink jet printing head corresponding to nozzles which are not executing ink drop discharge. In the ink refresh operation step, ink refresh operation, for removing the ink in the nozzles and replacing the ink with fresh ink, is periodically executed according to a refresh operation cycle which is appropriately set based on the temperature and/or humidity measured around the ink jet printing head. The ink refresh operation is executed by means of forcible ink drop discharge from the nozzles, ink suction by a pump, etc. For example, the refresh operation cycle is set shorter as the temperature around the ink jet printing head gets lower and as the humidity around the ink jet printing head gets lower. By the vibration application step and the ink refresh operation step with such setting of the refresh operation cycle, stable discharge of minute ink drops and high quality ink jet printing can be maintained for the long term even if the ink drop discharge pause period continued long, without causing large ink consumption and long printing time due to the ink refresh operation.

4 Claims, 12 Drawing Sheets

F I G. 11

| TEMPERATURE / HUMIDITY | T<10℃ | 10℃≦T≦30℃ | 30℃<T |
|---|---|---|---|
| H<30% | 3 (S) | 10 (S) | 30 (S) |
| 30%≦H≦50% | 8 (S) | 20 (S) | 40 (S) |
| 50%<H | 20 (S) | 40 (S) | 60 (S) |

DEVICE AND METHOD FOR DRIVING INK JET PRINTING HEAD CAPABLE OF ATTAINING BOTH HIGH QUALITY PRINTING AND REDUCTION OF INK CONSUMPTION

BACKGROUND OF THE INVENTION

The present invention relates to a driving device and a driving method for an ink jet printing head which executes printing of letters, figures, images, etc. on objects such as paper, by changing the volumes of its pressure-generation chambers which are filled with ink by means of actuators (piezoelectric vibrators etc.) and thereby discharging minute ink drops from its nozzles corresponding to the pressure-generation chambers.

DESCRIPTION OF THE PRIOR ART

Various types of drop-on-demand ink jet printers have been proposed as disclosed in Japanese Publication of Examined Patent Applications No.SHO-53-12138, Japanese Patent Application Laid-Open No.HEI10-193587, etc. In a so-called drop-on-demand ink jet printer, the volume of a pressure-generation chamber which is filled with ink is changed (increased/decreased) by means of an actuator such as a piezoelectric vibrator, and thereby a minute ink drop is discharged from a nozzle corresponding to the pressure-generation chamber.

FIG. 1 is a schematic cross sectional view showing the composition of an ink jet printing head. Referring to FIG. 1, the ink jet printing head 1 includes a plurality of pressure-generation chambers 17, a nozzle plate 11 as a wall for the pressure-generation chambers 17, nozzles 15 which are provided to the nozzle plate 11 corresponding to each of the pressure-generation chambers 17 for discharging ink drops 19, a vibration plate 13, piezoelectric actuators 14 corresponding to each of the pressure-generation chambers 17 for vibrating the vibration plate 13 and thereby changing the volumes of the pressure-generation chambers 17 so as to cause the ink drop discharge from the nozzles 15, and the ink chambers 18 which are connected to the pressure-generation chambers 17 for supplying ink from an unshown ink tank to the pressure-generation chambers 17 via ink supply channels 16, a wall 12 disposed between the nozzle plate 11 and the vibration plate 13 to form the ink chambers 18.

In the ink jet printing head having the composition shown in FIG. 1, when the vibration plate 13 is vibrated by a piezoelectric actuator 14, the volume of a corresponding pressure-generation chamber 17 filled with ink is changed by the vibration, and thereby an ink drop 19 is discharged from a corresponding nozzle 15. The discharged ink drop 19 reaches the surface of an object such as paper and thereby forms an ink dot on the object. By repetition of the formation of the ink dots, letters, figures, images, etc. based on an image data are printed on the object.

The ink jet printing head 1 is required to discharge the ink drops 19 stably in order to realize precise printing on the object based on the image data. However, in actual printing by the ink jet printing head, desired printed output can not always be obtained since the ink drop discharge tends to become unstable due to various factors. One of the factors is evaporation of volatile ingredients of the ink.

The ink which is used for the ink jet printing generally includes water as the main solvent, and coloring agents (various organic dyes etc.) and surface-active agents are added to the main solvent. When such type of ink is employed, the water as the main solvent of the ink tends to evaporate from the surface of the ink at the opening of the nozzle 15 as an ink drop discharge pause period (that is, a period in which the ink drops are not discharged from the nozzle 15) becomes longer, thereby the ink becomes viscous or fixed partially, causing the nozzle 15 to stop up.

In order to resolve the ink fixation problem and maintain constant viscosity of the ink, "ink refresh operation" is generally executed to the ink jet printing head, in which the ink jet printing head is withdrawn from the printing zone and the ink in the nozzles 15 is refreshed by means of forcible ink drop discharge, forcible ink suction by use of a pump, etc. However, in order to attain the stable ink drop discharge from the nozzles 15 and obtain high quality printed output, the above ink refresh operation has to be repeated frequently, thereby the consumption of the ink and printing cost are increased considerably and the need of handling and processing large amount of waste ink occurs.

Another method for avoiding the ink fixation problem without causing the increase of ink consumption has been disclosed in Japanese Patent Application Laid-Open No.SHO57-61576, in which a weak vibration, by which the ink drop discharge from the nozzle 15 is not caused, is applied by the piezoelectric actuator 14 to the vibration plate 13 and the pressure-generation chamber 17 also in the ink drop discharge pause periods.

FIGS. 2A through 2E are schematic cross sectional views of a nozzle of an ink jet printing head for explaining the above method disclosed in the Japanese Patent Application Laid-Open No.SHO57-61576.

Referring to FIG. 2A, ink 23 which is packed in the pressure-generation chamber 17 contacts air at the opening 21 of the nozzle 15.

Referring to FIG. 2B, at the interface (meniscus surface) 22 between the ink and air, evaporation of water in the ink 23 occurs and thereby a high viscosity ink layer 24 is formed near the meniscus surface 22.

When the weak vibration, which does not cause the ink drop discharge from the nozzle 15, is applied by the piezoelectric actuator 14 to the vibration plate 13 and the pressure-generation chamber 17, the meniscus exhibits small vibration as shown by the arrows in FIGS. 2C and 2D.

By the small meniscus vibration, the high viscosity ink layer 24 diffuses into the low viscosity ink 23 as shown in FIG. 2E, and thereby the viscosity of the ink in the pressure-generation chamber 17 becomes uniform. The reference character "25" shown in FIG. 2E indicates the ink having the uniform viscosity.

The above method is effective and applicable as long as the ink drop discharge pause period is short, however, the method can only slow the increase of the ink viscosity since the method does not execute replacement of the ink 23 in the nozzle 15. If the ink drop discharge pause period becomes long, fixation of the ink 23 in the nozzle 15 occurs eventually and thereby the following ink drop discharges become difficult or impossible.

In order to resolve the above problems, another ink jet printing method disclosed in Japanese Patent Application Laid-Open No.HEI9-29996 includes a "small vibration application process" in which the small vibration (which does not cause the ink drop discharge from the nozzle 15) is applied to the pressure-generation chamber 17 in the ink drop discharge pause period and an "ink refresh process" in which the ink jet printing head 1 is withdrawn from the printing zone periodically and the ink near the openings of the nozzles 15 and ink in the pressure-generation chambers 17 are forcibly discharged. In the ink refresh process, the amplitude of a refresh driving voltage waveform which is applied to the piezoelectric actuator 14 for the forcible ink drop discharge for the ink refresh operation is set larger than that of an discharge driving voltage waveform which is employed for ordinary ink drop discharge for printing, thereby discharge of large amount of ink and replacement of ink in the pressure-generation chamber 17 are conducted so as to avoid the fixation and bodying up of the ink for the long term.

However, in the above ink jet printing method of Japanese Patent Application Laid-Open No.HEI9-29996 employing the combination of the small meniscus vibration and the ink refresh operation (forcible ink drop discharge), the ink refresh operation (ink refresh process) is executed according to a fixed refresh operation cycle. The fixed refresh operation cycle has to be set short so as to be able to cover the severest possible condition within the operation-guaranteed ranges of the ink jet printing head 1. Therefore, also in the ink jet printing method of Japanese Patent Application Laid-Open No.HEI9-29996, ink consumption is necessitated to be large and printing speed is necessitated to be lowered due to the ink replacement (ink refresh operation).

Further, the size of the ink drop is becoming smaller and smaller these days due to the recent market requirements for high quality printing. As the ink drop size becomes smaller, even a little variation of the ink viscosity affects the print quality. For example, due to an ink drop discharge pause period of about 2 seconds under normal temperature and humidity, a fall of discharged ink drop speed of approximately 2 m/s occurs when the ink drop diameter is 25 $\mu$m, while the fall is only 0.5 m/s when the ink drop diameter is 40 $\mu$m. Therefore, the frequency of the ink refresh operation (forcible ink drop discharge) has to be increased as the size of the ink drop is made smaller, thereby the consumption of the ink also increases.

SUMMARY OF THE INVENTION

It is therefore the primary object of the present invention to provide a driving device and a driving method for an ink jet printing head, by which stable discharge of ink drops (especially, minute ink drops) and high quality ink jet printing can be maintained even if the ink drop discharge pause period continued long, without causing the large ink consumption and the long printing time due to the ink replacement (ink refresh operation).

In accordance with a first aspect of the present invention, there is provided a driving device for an ink jet printing head which has a plurality of pressure-generation chambers filled with ink, a plurality of nozzles corresponding to the pressure-generation chambers from which the ink in the pressure-generation chambers are discharged, and a plurality of driving means corresponding to the pressure-generation chambers for causing change of pressure in the pressure-generation chambers and thereby letting ink drops be discharged from the nozzles onto an object. The driving device for an ink jet printing head comprises a vibration application means and an ink refresh operation means. The vibration application means applies vibration, which does not cause the ink drop discharge from the nozzle, to the pressure-generation chambers corresponding to nozzles which are not executing ink drop discharge. The, ink refresh operation means periodically executes ink refresh operation for removing the ink in the nozzles and replacing the ink with fresh ink, according to a refresh operation cycle which is appropriately set based on the temperature and/or humidity measured around the ink jet printing head.

In accordance with a second aspect of the present invention, in the first aspect, the ink refresh operation is executed by means of forcible ink drop discharge from the nozzles.

In accordance with a third aspect of the present invention, in the first aspect, the ink refresh operation is executed by means of ink suction by a pump.

In accordance with a fourth aspect of the present invention, in the first aspect, the ink refresh operation means includes a refresh information storage means, a temperature/humidity measurement means, a refresh operation cycle setting means and an ink refresh operation execution means. In the refresh information storage means, data concerning appropriate refresh operation cycles corresponding to various temperature and/or humidity around the ink jet printing head are stored. The temperature/humidity measurement means measures the temperature and/or humidity around the ink jet printing head. The refresh operation cycle setting means reads out appropriate refresh operation cycle data from the refresh information storage means based on the temperature and/or humidity measured by the temperature/humidity measurement means, and sets the refresh operation cycle according to the refresh operation cycle data read out from the refresh information storage means. The ink refresh operation execution means periodically executes the ink refresh operation according to the refresh operation cycle which has been set by the refresh operation cycle setting means.

In accordance with a fifth aspect of the present invention, in the second aspect, the forcible ink drop discharge from the nozzles is executed by use of a refresh driving voltage waveform which is generated by a special-purpose refresh waveform generation circuit.

In accordance with a sixth aspect of the present invention, in the second aspect, the forcible ink drop discharge from the nozzles is executed by use of a discharge driving voltage waveform which is generally used for the discharge of ink drops of the largest size for ordinary printing.

In accordance with a seventh aspect of the present invention, in the second aspect, the forcible ink drop discharge from the nozzles is executed after withdrawing the ink jet printing head from the object.

In accordance with an eighth aspect of the present invention, in the first aspect, the refresh operation cycle is set shorter as the temperature around the ink jet printing head gets lower.

In accordance with a ninth aspect of the present invention, in the first aspect, the refresh operation cycle is set shorter as the humidity around the ink jet printing head gets lower.

In accordance with a tenth aspect of the present invention, in the first aspect, the refresh operation cycle is set shorter as the size of the ink drops discharged from the nozzles becomes smaller.

In accordance with an eleventh aspect of the present invention, there is provided a driving method for an ink jet printing head which has a plurality of pressure-generation chambers filled with ink, a plurality of nozzles corresponding to the pressure-generation chambers from which the ink in the pressure-generation chambers are discharged, and a plurality of driving means corresponding to the pressure-generation chambers for causing change of pressure in the pressure-generation chambers and thereby letting ink drops be discharged from the nozzles onto an object. The driving method for an ink jet printing head comprises a vibration application step and an ink refresh operation step. In the vibration application step, vibration which does not cause the ink drop discharge from the nozzle is applied to the pressure-generation chambers corresponding to nozzles which are not executing ink drop discharge. In the ink refresh operation step, ink refresh operation, for removing the ink in the nozzles and replacing the ink with fresh ink, is periodically executed according to a refresh operation cycle which is appropriately set based on the temperature and/or humidity measured around the ink jet printing head.

In accordance with a twelfth aspect of the present invention, in the eleventh aspect, the ink refresh operation is executed by means of forcible ink drop discharge from the nozzles.

In accordance with a thirteenth aspect of the present invention, in the eleventh aspect, the ink refresh operation is executed by means of ink suction by a pump.

In accordance with a fourteenth aspect of the present invention, in the eleventh aspect, the ink refresh operation step is implemented by a refresh operation cycle data storage step, a temperature/humidity measurement step, a refresh operation cycle setting step and an ink refresh operation execution step. In the refresh operation cycle data storage step, data concerning appropriate refresh operation cycles corresponding to various temperature and/or humidity around the ink jet printing head are stored in a refresh information storage means. In the temperature/humidity measurement step, the temperature and/or humidity around the ink jet printing head is measured. In the refresh operation cycle setting step, appropriate refresh operation cycle data is read out from the refresh information storage means based on the temperature and/or humidity measured in the temperature/humidity measurement step, and the refresh operation cycle is set according to the refresh operation cycle data read out from the refresh information storage means. In the ink refresh operation execution step, the ink refresh operation is periodically executed according to the refresh operation cycle which has been set in the refresh operation cycle setting step.

In accordance with a fifteenth aspect of the present invention, in the twelfth aspect, the forcible ink drop discharge from the nozzles is executed by use of a refresh driving voltage waveform which is generated by a special-purpose refresh waveform generation circuit.

In accordance with a sixteenth aspect of the present invention, in the twelfth aspect, the forcible ink drop discharge from the nozzles is executed by use of a discharge driving voltage waveform which is generally used for the discharge of ink drops of the largest size for ordinary printing.

In accordance with a seventeenth aspect of the present invention, in the twelfth aspect, the forcible ink drop discharge from the nozzles is executed after withdrawing the ink jet printing head from the object.

In accordance with an eighteenth aspect of the present invention, in the eleventh aspect, the refresh operation cycle is set shorter as the temperature around the ink jet printing head gets lower.

In accordance with a nineteenth aspect of the present invention, in the eleventh aspect, the refresh operation cycle is set shorter as the humidity around the ink jet printing head gets lower.

In accordance with a twentieth aspect of the present invention, in the eleventh aspect, the refresh operation cycle is set shorter as the size of the ink drops discharged from the nozzles becomes smaller.

BRIEF DESCRIPTION OF THE DRAWINGS

The objects and features of the present invention will become more apparent from the consideration of the following detailed description taken in conjunction with the accompanying drawings, in which:

FIG. 11 is a table which is employed for the control of a refresh operation cycle in a ink jet printing head driving device in accordance with a second embodiment of the present invention.

DESCRIPTION OF THE PREFERRED EMBODIMENTS

Figure 1:
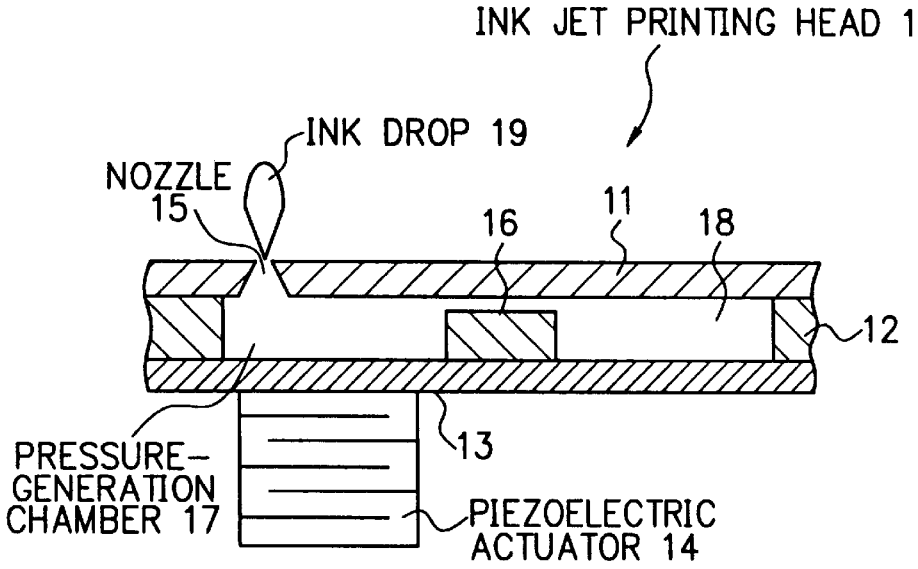
F I G. 1 PRIOR ART
FIG. 1 is a schematic cross sectional view showing the composition of an ink jet printing head.

Referring now to the drawings, a description will be given in detail of preferred embodiments in accordance with the present invention.

Figure 3:
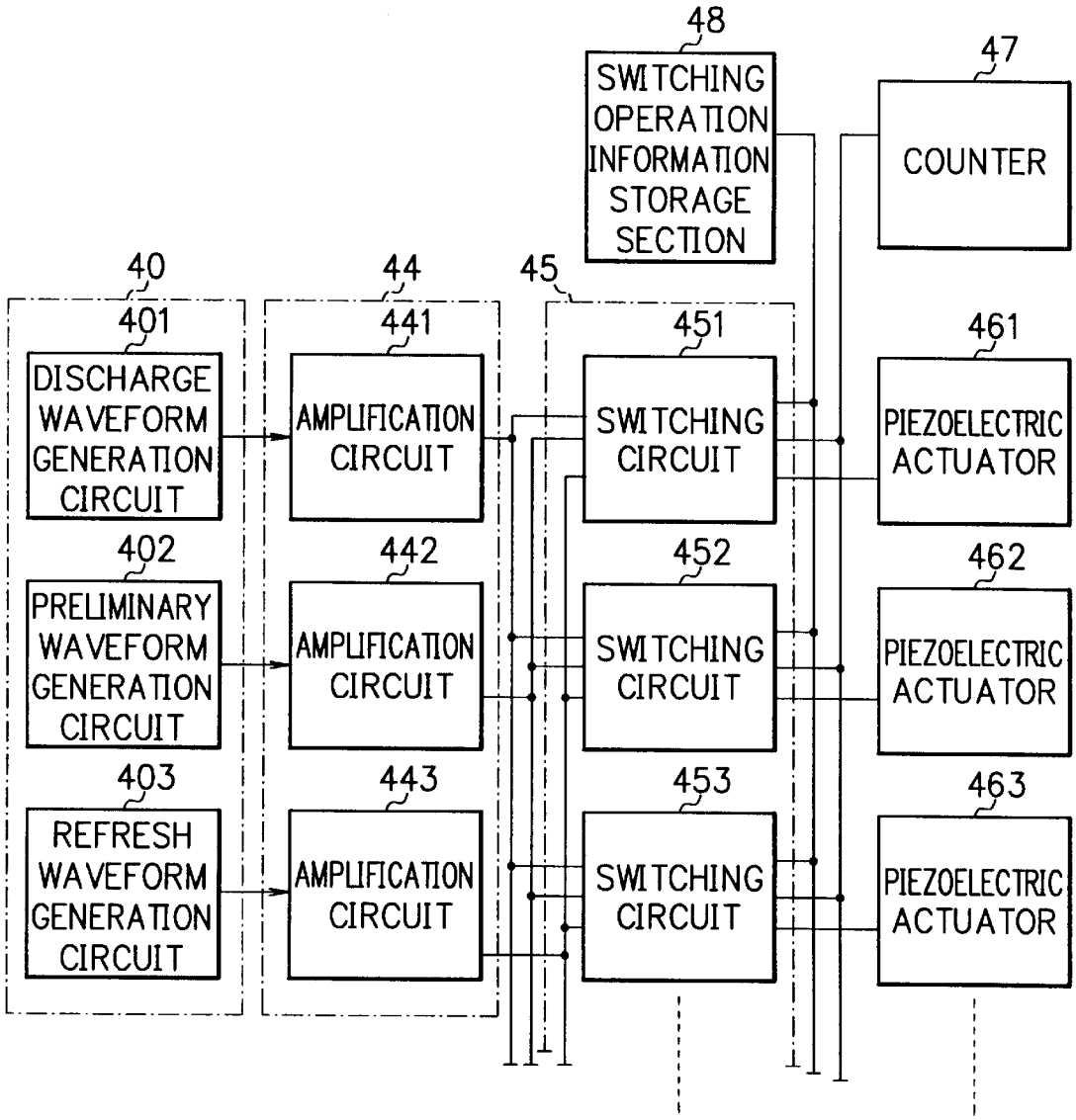
FIG. 3 is a block diagram showing the composition of an ink jet printing head driving device in accordance with a first embodiment of the present invention.
Figure 4:
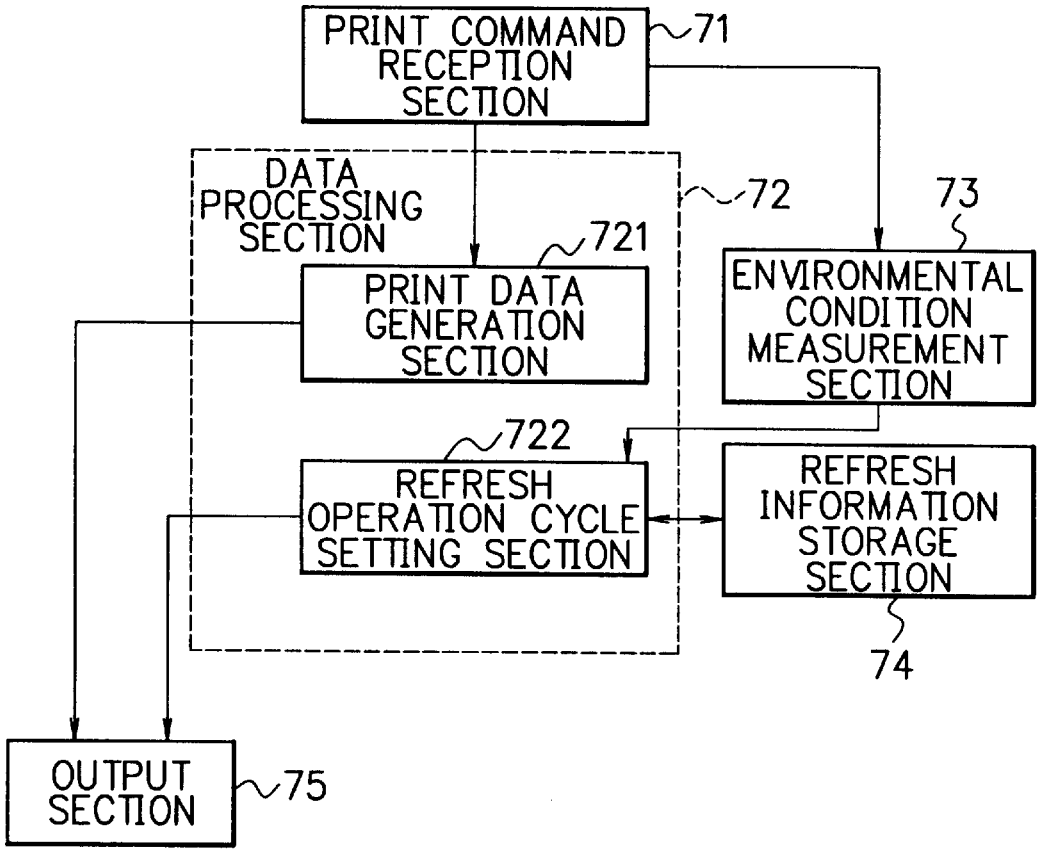
FIG. 4 is a block diagram showing the composition of a control section for controlling the ink jet printing head driving device of FIG. 3.

FIG. 3 is a block diagram showing the composition of an ink jet printing head driving device in accordance with a first embodiment of the present invention. FIG. 4 is a block diagram showing the composition of a control section (which is not shown in FIG. 3) for controlling the ink jet printing head driving device of FIG. 3. FIGS. 5A through 6B are graphs showing driving voltage waveforms which are generated by a waveform generation section 40 of the ink jet printing head driving device of FIG. 3.

The following explanation will be given using the reference characters of the parts of the ink jet printing head 1 which has been shown in FIG. 1. Repeated explanation of the parts is omitted for brevity.

The ink jet printing head driving device of FIG. 3 includes a waveform generation section 40 for generating driving voltage waveforms for driving piezoelectric actuators 461, 462, 463, . . . which apply vibrations to the vibration plate 13 and the pressure-generation chambers 17 of the ink jet printing head 1, an amplification section 44 for amplifying the driving voltage waveforms, a switching section 45 for switching the connections of signal lines for distributing the amplified driving voltage waveforms to the piezoelectric actuators 461, 462, 463, . . . , and a switching operation information storage section 48 for storing switching operation information (which is generated based on a print command which is supplied to the ink jet printing head driving device from outside) to be used for the switching operation of the switching section 45.

Incidentally, the control of the ink jet printing head driving device of FIG. 3 (such as signal transfer control between the parts of FIG. 3) is executed by the control section of FIG. 4 which will be explained later.

The piezoelectric actuators 461, 462, 463, . . . can be implemented by general layered piezoelectric actuators capable of generating vibrations of longitudinal vibration mode, however, other types of piezoelectric actuators such as single plate piezoelectric actuators, bending (deflection) vibration mode piezoelectric actuators, etc. can also be employed. The piezoelectric actuators 461, 462, 463, . . . employed in this embodiment can also be replaced with other types of actuators such as actuators making use of electrostatic force, magnetic force, etc.

Figure 2A:
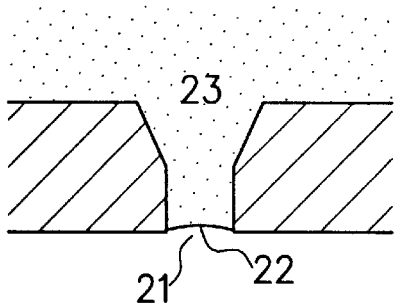
FIG. 2A PRIOR ART
FIGS. 2A through 2E are schematic cross sectional views of a nozzle of an ink jet printing head for explaining an ink jet printing head driving method which has been disclosed in the Japanese Patent Application Laid-Open No.SHO57-61576.
Figure 2B:
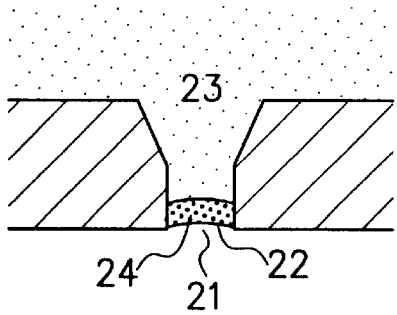
FIG. 2B PRIOR ART
Figure 2C:
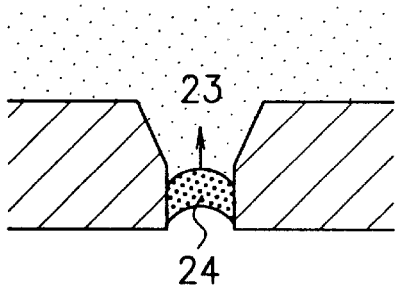
FIG. 2C PRIOR ART
Figure 2D:
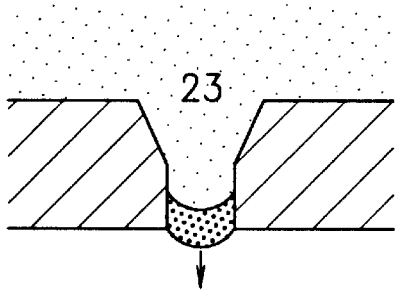
FIG. 2D PRIOR ART
Figure 2E:
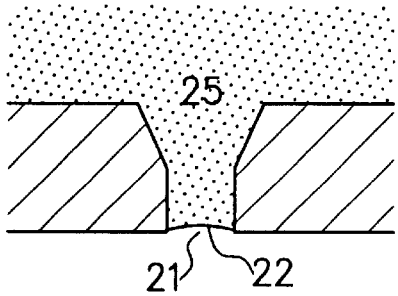
FIG. 2E PRIOR ART

The waveform generation section 40 includes a discharge waveform generation circuit 401 for generating discharge driving voltage waveforms for the ink drop discharge, a preliminary waveform generation circuit 402 for generating preliminary driving voltage waveforms for vibrating the vibration plate 13 and the pressure-generation chambers 17 and thereby applying the small vibrations to the meniscus surfaces 22 (see FIGS. 2C and 2D) in the ink drop discharge pause periods, and a refresh waveform generation circuit 403 for generating refresh driving voltage waveforms for the ink refresh operation for forcibly discharging the ink in the nozzles 15.

The discharge waveform generation circuit 401 is capable of generating three types of discharge driving voltage waveforms so as to be able to change the diameter of the discharged ink drop among "large", "middle" and "small". The driving voltage waveforms generated by the waveform generation circuits 401, 402 and 403 are shown in FIGS. 5A through 6B.

Figure 5A:
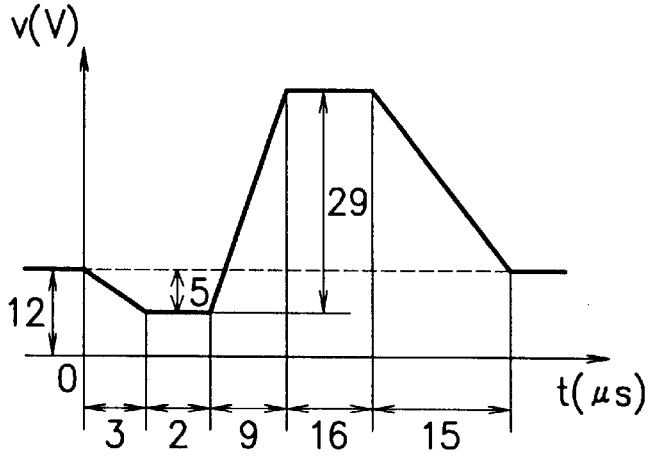
FIGS. 5A through 5C are graphs showing discharge driving voltage waveforms for three discharged ink drop sizes ("large", "middle" and "small") which are generated by a discharge waveform generation circuit of the ink jet printing head driving device of FIG. 3.
Figure 5B:
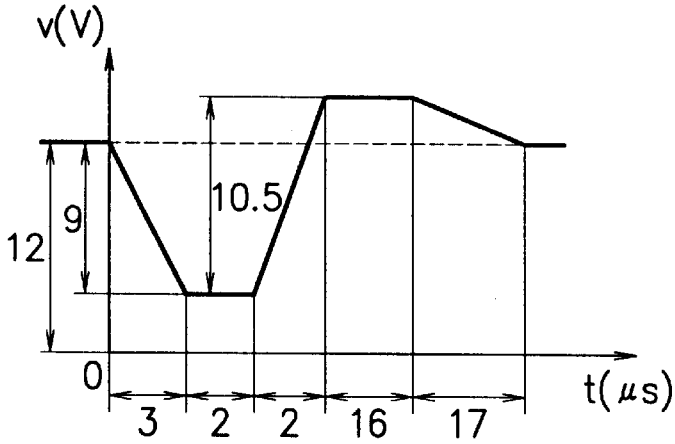
Figure 5C:
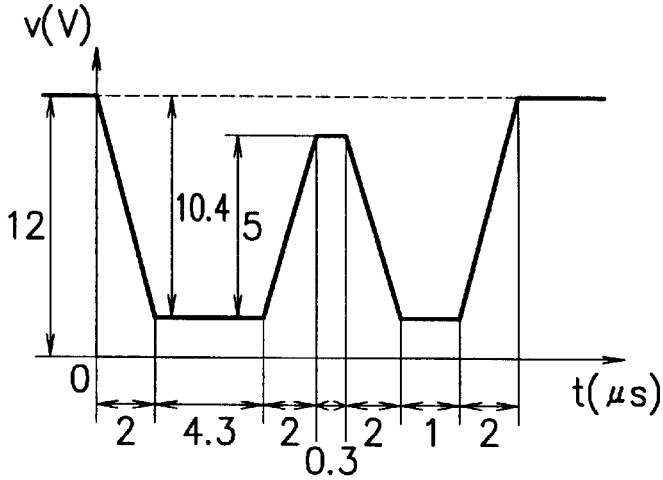

FIGS. 5A through 5C show the discharge driving voltage waveforms which are generated by the discharge waveform generation circuit 401, in which FIG. 5A, FIG. 5B and FIG. 5C correspond to the ink drop diameters "large", "middle" and "small", respectively.

Figure 6A:
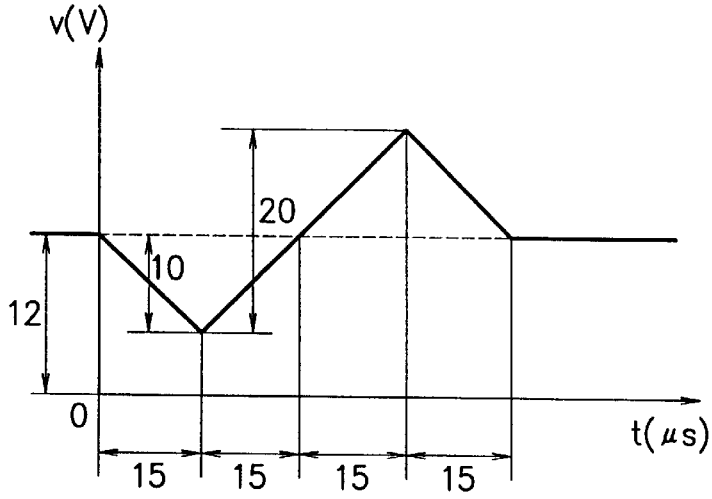
FIGS. 6A and 6B are graphs showing a preliminary driving voltage waveform and a refresh driving voltage waveform which are generated by a preliminary waveform generation circuit and a refresh waveform generation circuit of the ink jet printing head driving device of FIG. 3.
Figure 6B:
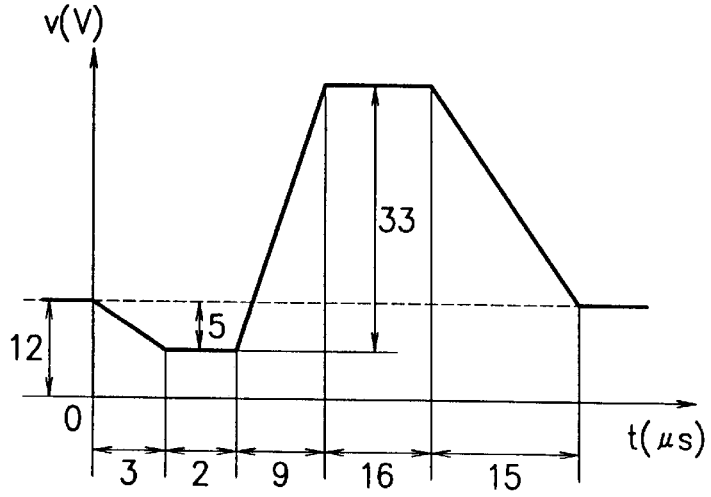

FIG. 6A shows the preliminary driving voltage waveform which is generated by the preliminary waveform generation circuit 402, and FIG. 6B shows the refresh driving voltage waveform which is generated by the refresh waveform generation circuit 403.

In each FIGS. 5A~6B, the horizontal axis denotes time ($\mu$s) and the vertical axis denotes voltage (V). The driving voltage waveforms shown in FIGS. 5A through 6B are only examples, and thus other types of driving voltage waveforms can also be employed as long as similar effects can be attained by the driving voltage waveforms by vibrating the pressure-generation chambers 17.

The amplification section 44 includes amplification circuits 441, 442 and 443 corresponding to the waveform generation circuits 401, 402 and 403 of the waveform generation section 40. The driving voltage waveforms generated by the waveform generation circuits 401, 402 and 403 are supplied to the amplification circuits 441, 442 and 443 and amplified by the amplification circuits 441, 442 and 443, respectively.

The amplification circuits 441, 442 and 443 are connected to the piezoelectric actuators 461, 462, 463, . . . via signal lines and the switching section 45. The switching section 45, which is placed between the amplification circuits 441, 442 and 443 (amplification section 44) and the piezoelectric actuators 461, 462, 463, . . . so as to execute switching of the connections of the signal lines, includes switching circuits 451, 452, 453, . . . corresponding to the piezoelectric actuators 461, 462, 463, . . . . Each switching circuit (451, 452, 453, . . . ), which is connected to all the amplification circuits 441, 442 and 443 and a corresponding piezoelectric actuator (461, 462, 463, . . . ) via signal lines, switches ON/OFF of the connection between the corresponding piezoelectric actuator and each amplification circuit (441, 442 and 443). Concretely, each switching circuit (451, 452, 453, . . . ) selects a driving voltage waveform out of the five amplified driving voltage waveforms which are supplied from the amplification circuits 441, 442 and 443 and supplies the selected driving voltage waveform to the corresponding piezoelectric actuator (461, 462, 463, . . . ).

More concretely, the discharge waveform generation circuit 401 outputs the discharge driving voltage waveforms of FIGS. 5A, 5B and 5C for the ink drop diameters "large", "middle" and "small", successively and repeatedly. Each switching circuit (451, 452, 453, . . . ) executes selection from the amplification circuits 441, 442 and 443, and each switching circuit that selected the amplification circuit 441 (the discharge driving voltage waveforms) executes selection from the ink drop diameters "large", "middle" and "small" (that is, from the discharge driving voltage waveforms of FIGS. 5A, 5B and 5C) by means of time division operation.

The switching operations of the switching circuits 451, 452, 453, . . . (that is, the selection of the driving voltage waveforms) are conducted based on the switching operation information which is stored in the switching operation information storage section 48. The switching operation information is preliminarily generated by the control section based on a print command which is supplied from outside (personal computer, etc.) and stored in the switching operation information storage section 48.

Incidentally, the reference character "47" shown in FIG. 3 denotes a counter for counting the number of printed lines. When the printed line number counted by the counter 47 reached a number that is determined by the print command, the printing is finished. The cycle of the ink refresh operation can also be determined based on the count of the counter 47.

FIG. 4 shows the composition of the control section which executes the control of the switching operation of the switching circuits 451, 452, 453, . . . of the switching section 45 and the control of the ink refresh operation depending on the temperature and humidity around the ink jet printing head 1.

The control section shown in FIG. 4 includes a print command reception section 71 for receiving a print command instructing the ink jet printing head 1 to execute printing, an environmental condition measurement section 73 (including a temperature sensor, a humidity sensor, etc.) for measuring the temperature and/or humidity around the ink jet printing head 1 when the print command is supplied to the print command reception section 71, a refresh information storage section 74 for storing information (data) concerning appropriate refresh operation cycles corresponding to various temperature and humidity around the ink jet printing head 1, a data processing section 72 which reads out data concerning an appropriate refresh operation cycle (refresh operation cycle data) from the refresh information storage section 74 depending on the temperature and/or humidity measured by the environmental condition measurement section 73 and which generates print data by processing the print command received by the print command reception section 71, and an output section 75 which outputs the switching operation information based on the refresh operation cycle data and the print data outputted by the data processing section 72 to the switching operation information storage section 48.

The data processing section 72 of the control section includes a print data generation section 721 and a refresh operation cycle setting section 722. The print data generation section 721 generates print data based on the print command which is supplied to the print command reception section 71 from outside (personal computer, etc.). The refresh operation cycle setting section 722 sets the refresh operation cycle by receiving the measurement result (temperature and/or humidity) from the environmental condition measurement section 73 and reading out appropriate refresh operation cycle data from the refresh information storage section 74 based on the measurement result.

The refresh operation cycle data stored in the refresh information storage section 74 are preliminarily determined appropriately based on measurement results etc. with regard to various temperature and/or humidity around the ink jet printing head 1.

The print data and the refresh operation cycle data outputted by the print data generation section 721 and the refresh operation cycle setting section 722 of the data processing section 72 are supplied to the output section 75. The output section 75 outputs the switching operation information based on the print data and the refresh operation cycle data to the switching operation information storage section 48.

Figure 7:
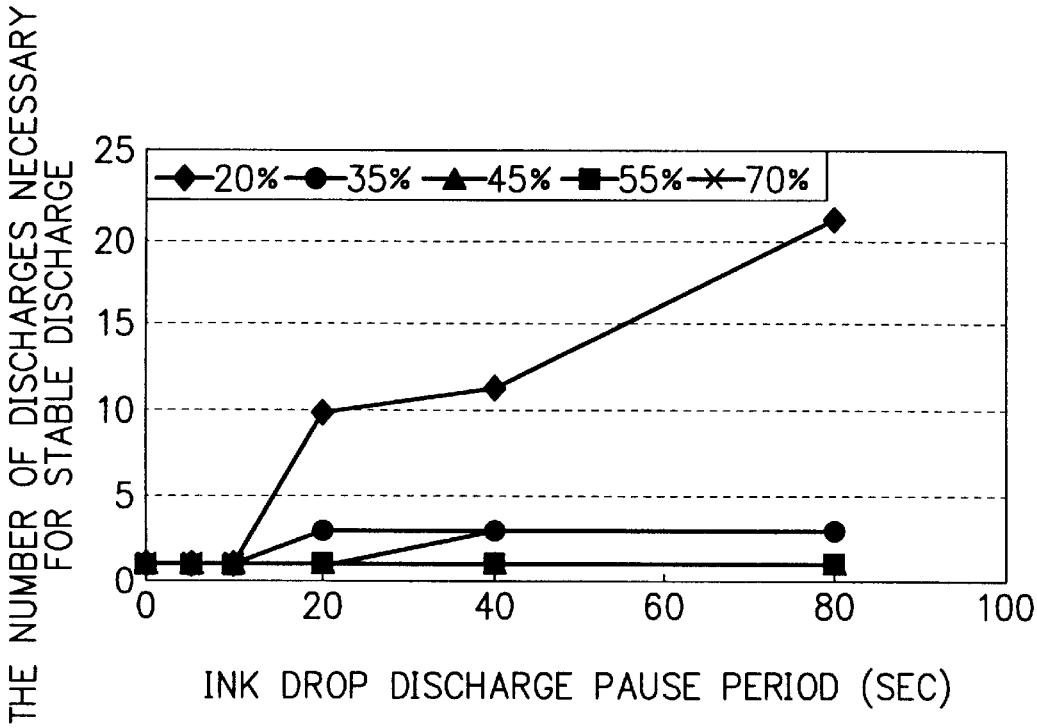
FIG. 7 is a graph showing the relationship between the length of an ink drop discharge pause period and the number of ink drop discharges necessary for realizing stable ink drop discharge after the ink drop discharge pause period, when the temperature around the ink jet printing head is fixed at 25° C. and the humidity is changed (20%, 35%, 45%, 55%, 70%)
Figure 8:
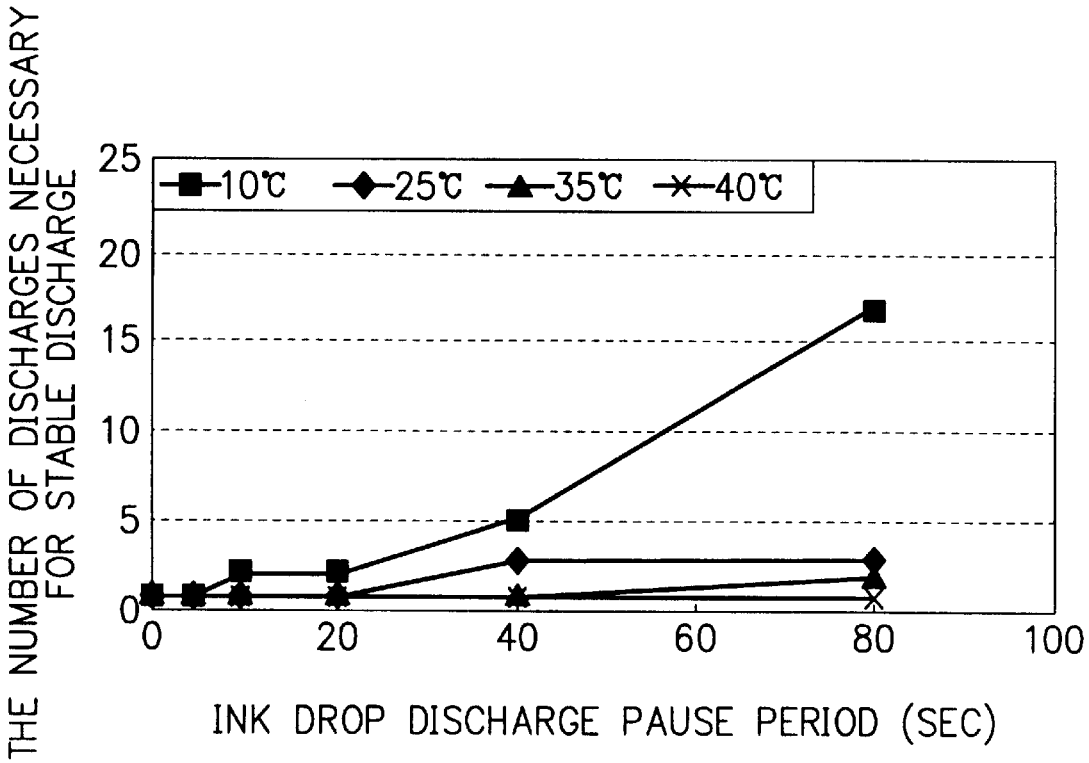
FIG. 8 is a graph showing the relationship between the length of the ink drop discharge pause period and the number of ink drop discharges necessary for realizing stable ink drop discharge after the ink drop discharge pause period, when the humidity around the ink jet printing head is fixed at 45% and the temperature is changed (10° C., 25° C., 35° C., 40° C.)

FIGS. 7 and 8 are graphs showing the relationships between the length of the ink drop discharge pause period and the number of ink drop discharges necessary for realizing stable ink drop discharge after the ink drop discharge pause period, in which FIG. 7 shows the relationship when the temperature around the ink jet printing head 1 is fixed at 25° C. and the humidity is changed (20%, 35%, 45%, 55%, 70%), and FIG. 8 shows the relationship when the humidity around the ink jet printing head 1 is fixed at 45% and the temperature is changed (10° C., 25° C., 35° C., 40° C.).

Referring to FIG. 7, in the cases where the humidity is 55% or more, stable ink drop discharge can be realized from the first ink drop discharge after the ink drop discharge pause period, even if the ink drop discharge pause period continued for 80 seconds. The stable ink drop discharge without the need of preliminary ink drop discharge can be maintained in the cases since the evaporation of water from the ink at the opening of the nozzle barely occurs when the humidity is 55% or more.

When the humidity becomes lower than 55%, the length of the ink drop discharge pause period (after which stable ink drop discharge can be realized without the need of preliminary ink drop discharges) gets shorter rapidly. For example, if the humidity becomes 45%, the length of the period becomes 20 seconds, and if the humidity becomes 35% or less, even an ink drop discharge pause period of approximately 10 seconds deteriorates the stability of the next ink drop discharge.

Referring to FIG. 8, when the temperature is 40° C. or more, stable ink drop discharge can be realized without the need of the preliminary ink drop discharges even if the ink drop discharge pause period continued for 80 seconds. When the temperature is 35° C., the stable ink drop discharge without the preliminary ink drop discharges can be realized after an ink drop discharge pause period of 40 seconds. However, when the temperature is lowered to 25° C., the stable ink drop discharge without the preliminary ink drop discharges becomes impossible if the ink drop discharge pause period continues for more than 20 seconds. When the temperature is further lowered to 10° C., the stable ink drop discharge without the preliminary ink drop discharges is impossible even if the ink drop discharge pause period is 1 second. The above results can be explained by rapid increase of ink drop viscosity as the temperature decreases.

As explained above, the increase speed of the ink drop viscosity varies depending on the temperature and humidity around the ink jet printing head 1, therefore, in the conventional case where the refresh operation cycle is set to a constant, the cycle has to be set short so as to be able to cover the severest possible condition within the operation-guaranteed ranges of the ink jet printing head 1. Therefore, by such fixed setting of the refresh operation cycle, ink consumption becomes large and printing speed is necessitated to be lowered due to the ink refresh operation. For instance, in the case of FIGS. 7 and 8, the refresh operation cycle has to be set to 1 second.

In order to resolve the above problems, in the first embodiment, a temperature sensor is provided to the environmental condition measurement section 73 in order to detect the temperature around the ink jet printing head 1 and thereby control the refresh operation cycle. The installation and the operation of the temperature sensor will be explained below concretely referring to FIG. 9.

Figure 9:
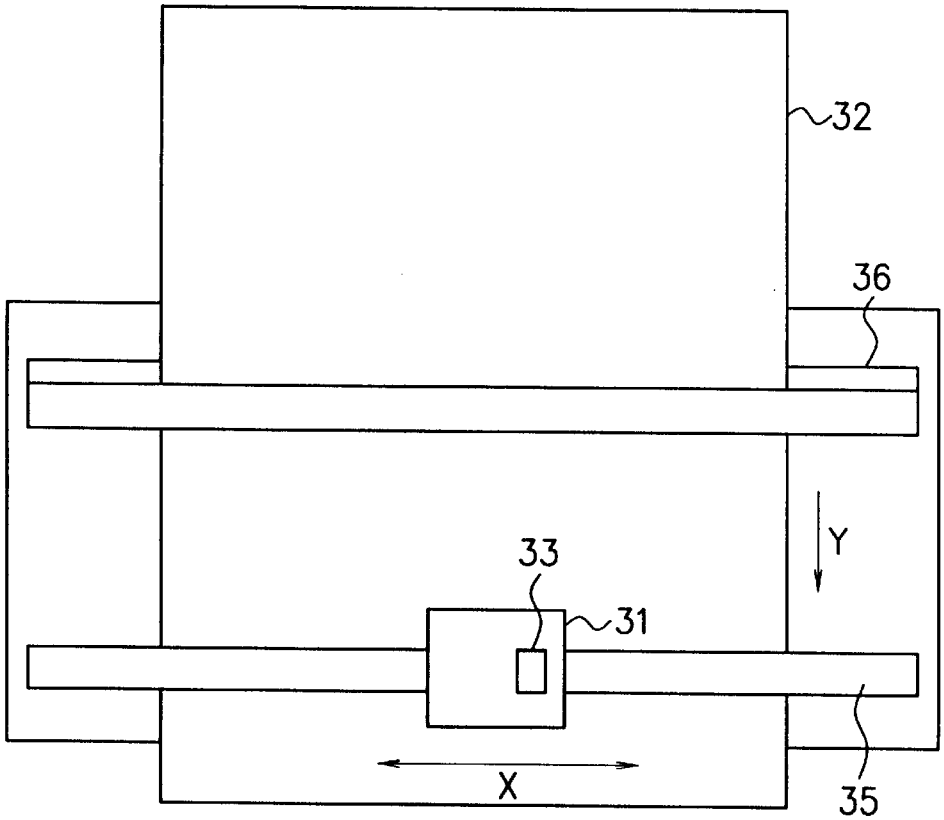
FIG. 9 is a schematic plan view showing an example of the installation of a temperature sensor in an ink jet printer.

FIG. 9 is a schematic plan view showing an example of the installation of the temperature sensor in an ink jet printer. The ink jet printing head 1 (which is not shown in FIG. 9) is provided to a carriage 31 which moves in the X-direction shown in FIG. 9 along a guide 35 which is attached to the main body of the ink jet printer. The object 32 (paper etc.) is fed by a feed roller 36 in the Y-direction shown in FIG. 9 which is perpendicular to the X-direction. By the combination of the X-direction movement of the carriage 31 and the Y-direction feed of the object 32, printing on the object 32 is executed. The temperature sensor 33 (as the environmental condition measurement section 73 of the control section) is attached to the carriage 31. The temperature sensor 33 measures the temperature around the ink jet printing head 1 constantly or periodically and sends the result to the refresh operation cycle setting section 722 of the control section.

The refresh operation cycle is set by the refresh operation cycle setting section 722 of the control section depending on the temperature measured by the temperature sensor 33. For example, the refresh operation cycle is set to 8 seconds when the measured temperature around the ink jet printing head 1 is lower than 10° C., 20 seconds when the measured temperature is 10° C.~30° C., and 40 seconds when the measured temperature is higher than 30° C.

When the present inventors conducted a printing test employing the above settings of the refresh operation cycles, satisfactory print results could be obtained in the whole operation-guaranteed ranges (temperature: 5° C.~40° C., humidity: 20% 70%) of the ink jet printing head 1.

Figure 10:
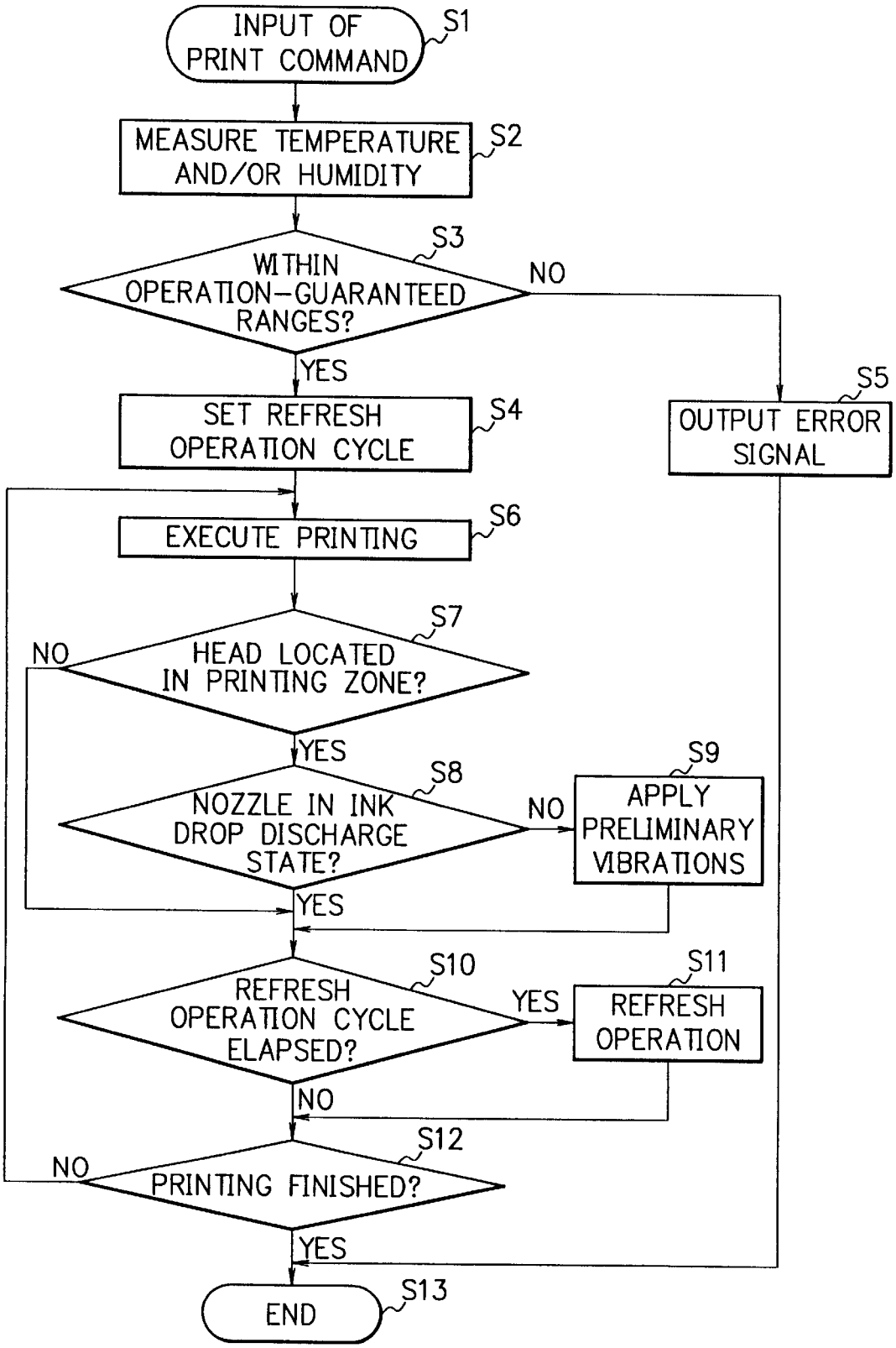
FIG. 10 is a flow chart for explaining the operation of the ink jet printing head driving device of the first embodiment.

In the following, the operation of the ink jet printing head driving device in accordance with the first embodiment of the present invention will be explained in detail referring to FIGS. 3 through 10. FIG. 10 is a flow chart for explaining the operation of the ink jet printing head driving device of the first embodiment.

First, optimum lengths of the refresh operation cycles corresponding to various temperature and humidity around the ink jet printing head 1 are preliminarily obtained by actually changing the temperature and humidity around the ink jet printing head 1 and conducting experiments like those shown in FIGS. 7 and 8. Data concerning the obtained refresh operation cycle lengths corresponding to various temperature and humidity are preliminarily stored in the refresh information storage section 74.

When a print command is supplied to the ink jet printing head driving device from outside (personal computer etc.) (step S1), the environmental condition measurement section 73 measures environmental conditions (temperature and/or humidity) around the ink jet printing head 1 (step S2). If the temperature and/or humidity measured by the environmental condition measurement section 73 are within the operation-guaranteed ranges of the ink jet printing head 1 ("Yes" in step S3), the process proceeds to step S4. If else ("No" in step S3), an error signal is outputted (step S5) and the printing process is ended (step S13).

In the step S4, the refresh operation cycle setting section 722 sets the cycle of the ink refresh operation, by reading out appropriate refresh operation cycle data corresponding to the measured temperature and/or humidity from the refresh information storage section 74. Thereafter, printing is started (step S6).

During the printing, if the ink jet printing head 1 is located in its printing zone ("Yes" in step S7), with regard to nozzles 15 which are not in their ink drop discharge states (that is, with regard to nozzles 15 which are in their ink drop discharge pause periods) ("No" in step S8), preliminary vibrations which do not cause the ink drop discharge from the nozzles 15 are applied to corresponding pressure-generation chambers 17 (step S9).

Subsequently, if the refresh operation cycle has elapsed ("Yes" in step S10), the ink refresh operation (forcible ink drop discharge) is executed for the nozzles 15 regardless of whether each nozzle 15 has been in its ink drop discharge state or not, thereby ink in the nozzles 15 which has become viscous is replaced with fresh ink of low viscosity (step S11). The refresh operation cycle can generally be counted by a timer, however, the count of the counter 47 for counting the number of printed lines can also be used for counting the refresh operation cycle.

Subsequently, if the printing has been finished, that is, if the count of the counter 47 has reached the number that is determined by the print command ("Yes" in step S12), the printing process is ended (step S13). If else ("No" in the step S12), the process is returned to the step S6 and the printing process is continued.

FIG. 11 is a table which is employed for the control of the refresh operation cycle in a ink jet printing head driving device in accordance with a second embodiment of the present invention. In the second embodiment, a humidity sensor, in addition to the temperature sensor 33, is further provided to the ink jet printing head 1 or to the carriage 31 (see FIG. 9) to which the (unshown) ink jet printing head 1 is provided, and the refresh operation cycle is set flexibly as shown in FIG. 11 depending on both the temperature and humidity measured by the temperature sensor 33 and the humidity sensor.

When the present inventors conducted a printing test employing the refresh operation cycle setting shown in FIG. 11, satisfactory print results could be obtained even in low-temperature low-humidity conditions (10° C., 20%). On the other hand, in high-temperature high-humidity conditions (30° C., 60%), the ink consumption could be reduced to 1/20 in comparison with the low-temperature low-humidity case.

As described above, by the flexible setting of the refresh operation cycle depending on both the temperature and humidity, satisfactory printing performance of the ink jet printing head 1 and reduction of the ink consumption can be attained in wide ranges of environmental conditions.

Figure 12A:
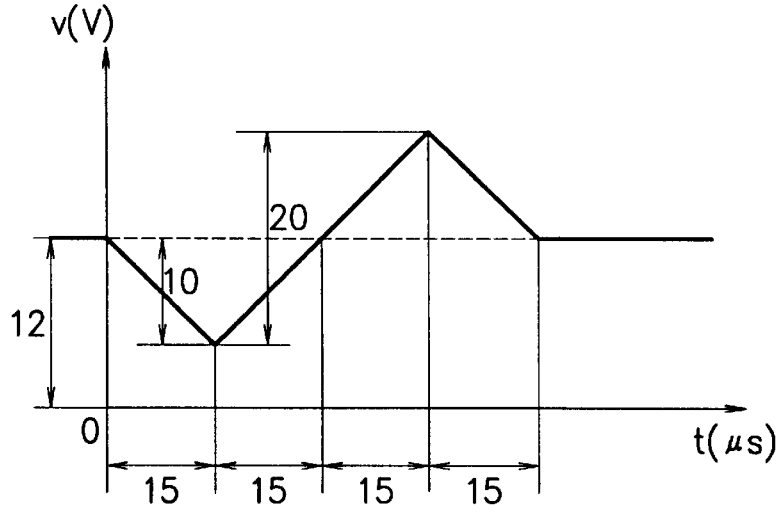
FIGS. 12A and 12B are graphs showing a preliminary driving voltage waveform and a refresh driving voltage waveform which are employed by an ink jet printing head driving device in accordance with a third embodiment of the present invention.
Figure 12B:
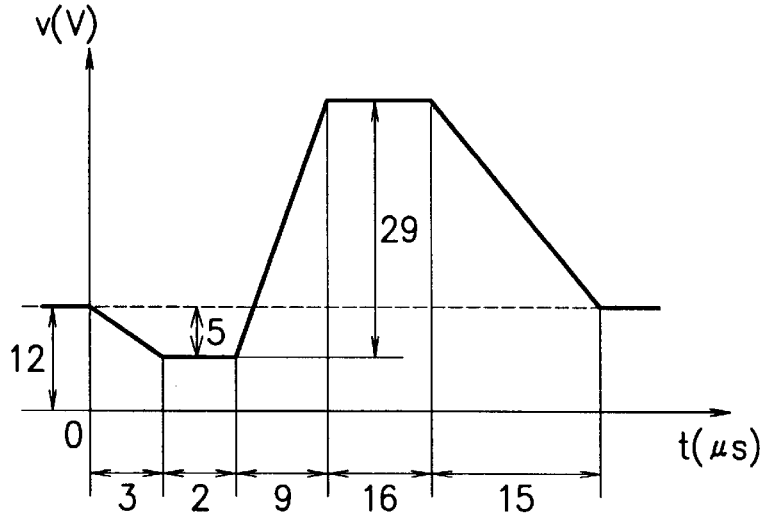

FIGS. 12A and 12B are graphs showing a preliminary driving voltage waveform and a refresh driving voltage waveform which are employed by an ink jet printing head driving device in accordance with a third embodiment of the present invention. The driving voltage waveforms shown in FIGS. 12A and 12B correspond to those of the first embodiment which have been shown in FIGS. 6A and 6B. Incidentally, the discharge driving voltage waveforms of FIGS. 5A through 5C for "large", "middle" and "small" ink drop diameters are also used in the third embodiment for the ordinary ink drop discharge.

As shown in FIG. 12B, the refresh driving voltage waveform employed in the third embodiment is the same as the discharge driving voltage waveform of FIG. 5A for the "large" ink drop diameter. In other words, the ink refresh operation in the third embodiment is executed by use of the discharge driving voltage waveform for the "large" ink drop diameter, without specially employing the refresh driving voltage waveform of FIG. 6B. When the present inventors conducted a printing test employing the driving voltage waveforms of FIGS. 5A through 5C and FIGS. 12A and 12B, satisfactory print results could be obtained in the whole operation-guaranteed ranges of the ink jet printing head 1, similarly to the case of the second embodiment.

The above result means that the discharge driving voltage waveform of FIG. 5A for the "large" ink drops could also be used for the ink refresh operation successfully. By such setting of the driving voltage waveforms, the special-purpose refresh waveform generation circuit 403 becomes unnecessary, thereby the composition of the ink jet printing head driving device can be simplified and the cost for the device can be reduced.

As described above, in the ink jet printing head driving devices and the ink jet printing head driving methods in accordance with the embodiments of the present invention, a temperature sensor and/or a humidity sensor is provided to the ink jet printing head 1 and an appropriate refresh operation cycle is set flexibly depending on the measured temperature and/or humidity around the ink jet printing head 1, thereby both satisfactory printing performance and reduction of ink consumption can be attained.

While the smallest ink drop diameter "small" was set to 20 $\mu$m and the refresh operation cycles of FIG. 11 were the most appropriate setting in the above embodiments, the refresh operation cycles can be set longer than those of FIG.

11 when the ink drop diameter "small" is set larger than 20 μm. On the other hand, when the ink drop diameter "small" is set smaller than 20 μm, the refresh operation cycles have to be set shorter than those of FIG. 11. Needless to say, the setting of FIG. 11 is only an example and appropriate refresh operation cycles corresponding to various temperature and/or humidity and various ink drop sizes vary depending on which ink is employed, and thus the appropriate refresh operation cycles should be determined based on experiments etc. with regard to the employed ink.

While the ink jet printing head 1 which has been shown in FIG. 1 was a Kyser-type ink jet printing head, the present invention can also be applied to ink jet printing heads of various types, such as an ink jet printing head whose pressure-generation chambers are implemented by grooves which are provided to piezoelectric actuators. The object 32 to which the ink jet printing head 1 executes printing is not limited to paper, but can be a polymer film, glass, etc. Therefore, the ink jet printing head driving device and the ink jet printing head driving method in accordance with the present invention can be applied to the manufacture of color filters of display devices, etc. Further, the ink is not limited to coloring ink, and thus the present invention can also be applied to ink jet printers for discharging melted solder and thereby forming solder bumps (for the mounting of parts) on circuit boards.

Moreover, while the ink refresh operation in the above embodiments was executed by means of forcible ink drop discharge, the present invention can also be applied to ink jet printing heads which execute the ink refresh operation by means of ink suction by a pump.

As set forth hereinabove, by the ink jet printing head driving device and the ink jet printing head driving method in accordance with the present invention, stable discharge of minute ink drops and high quality ink jet printing can be maintained for the long term even if the ink drop discharge pause period continued long, without causing the large ink consumption and the long printing time due to the ink refresh operation.

In the case (the third embodiment) where the ink refresh operation is executed employing the discharge driving voltage waveform for the "large" ink drops, the special-purpose refresh waveform generation circuit becomes unnecessary and thereby the composition of the ink jet printing head driving device can be simplified and the cost for the device can be reduced.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A driving device for an ink jet printing head having at least a plurality of pressure-generation chambers filled with ink, a plurality of nozzles communicating with the pressure-generation chambers, respectively, for discharging the ink, and a plurality of driving means corresponding to the pressure-generation chambers for causing change of pressure in the pressure-generation chambers, utilizing a plurality of driving voltage waveforms for driving the driving means to let various types of ink drops of different amount be discharged from the nozzles onto a recording medium based on a printing mode and printing data, comprising:

a preliminary waveform generation means for generating a driving voltage waveform used for driving the driving means to the extent that ink drops are not discharged from the nozzles at a discharge break during the printing when ink drops are not supposed to be discharged from the nozzles; and a purge waveform generation means for generating a driving voltage waveform used for discharging ink inside the nozzles at certain intervals set based on at least one of a temperature and humidity around the ink jet printing head and the amount of ink drops of the smallest size used under a selected printing mode;

wherein the preliminary waveform generation means and the purge waveform generation means are performed at different times and independently from each other;

wherein the preliminary waveform generation means can be performed while the ink jet printing head is scanning, the preliminary waveform generation means for vibrating a meniscus of the ink in each of the nozzles to the extent that ink drops are not discharged from the nozzles, churning the ink of increased viscosity, and decreasing an influence of the increased viscosity; and wherein the purge waveform generation means is performed while the ink jet printing head is outside of a print region, the purge waveform generation means for emitting the ink of increased viscosity and refreshing the ink in the pressure-generation chambers.

2. The driving device for the ink jet printing head as claimed in claim 1, wherein the purge waveform generation means generates a driving voltage waveform used for discharging ink drops of the largest size among other sizes of ink drops used in printing.

3. The driving device for the ink jet printing head as claimed in claim 1, further comprising:

a measuring means for measuring at least one of the temperature and humidity around the ink jet printing head; and a processing means for processing a measurement result obtained by the measuring means in order to transmit a suitable driving voltage waveform generation signal to the purge waveform generation means.

4. The driving device for the ink jet printing head as claimed in claim 2, further comprising:

a measuring means for measuring at least one of the temperature and humidity around the ink jet printing head; and a processing means for processing a measurement result obtained by the measuring means in order to transmit a suitable driving voltage waveform generation signal to the purge waveform generation means.

* * * * *